US005884515A

United States Patent [19]

Milman

[11] Patent Number: 5,884,515

[45] Date of Patent: Mar. 23, 1999

[54] ELECTROMAGNETIC CLUTCH FOR ELECTRONIC LOCKS

[75] Inventor: Sheldon Milman, Wheeling, Ill.

[73] Assignee: ILCO Unican Corp., St. Charles, Ill.

[21] Appl. No.: 937,028

[22] Filed: Sep. 24, 1997

[51] Int. Cl.[6] ..... E05B 47/00

[52] U.S. Cl. ..... 70/472; 70/149; 70/189; 70/223; 70/276; 70/277; 70/283; 192/84.9; 192/84.21; 292/251.5; 292/DIG. 27

[58] Field of Search ..... 70/276–283, 188, 70/189, 422, 149, 472, 218, 221–223; 292/251.5, 144, DIG. 27; 192/84.21, 84.9

[56] References Cited

U.S. PATENT DOCUMENTS

| | | | |
|---|---|---|---|
| 1,005,496 | 10/1911 | Armbruster | 292/DIG. 27 X |
| 3,748,878 | 7/1973 | Balzano et al. | 70/277 X |
| 4,073,527 | 2/1978 | Schlage | 292/347 |
| 4,534,194 | 8/1985 | Aydin | 70/276 X |
| 4,631,944 | 12/1986 | Gater et al. | 70/472 |
| 4,671,087 | 6/1987 | Olenfalk et al. | 292/DIG. 27 X |
| 4,672,829 | 6/1987 | Gater et al. | 70/472 |
| 4,920,773 | 5/1990 | Surko, Jr. | 70/224 |
| 4,972,694 | 11/1990 | Aulbers et al. | 70/277 |
| 5,000,018 | 3/1991 | Eisermann | 70/277 |
| 5,010,752 | 4/1991 | Lin | 70/277 |
| 5,012,659 | 5/1991 | Eisermann | 70/276 |
| 5,018,375 | 5/1991 | Tully | 70/472 |
| 5,040,391 | 8/1991 | Lin | 70/277 |
| 5,057,830 | 10/1991 | Eisermann | 340/825.31 |
| 5,394,717 | 3/1995 | Yu | 70/276 |
| 5,421,178 | 6/1995 | Hamel et al. | 70/283 |
| 5,439,260 | 8/1995 | Weinerman et al. | 292/48 |
| 5,475,996 | 12/1995 | Chen | 70/279 |
| 5,791,177 | 8/1998 | Bianco | 70/422 X |

FOREIGN PATENT DOCUMENTS

| | | | |
|---|---|---|---|
| 648709 | 2/1979 | U.S.S.R. | 292/144 |

*Primary Examiner*—Lloyd A. Gall
*Attorney, Agent, or Firm*—Hill & Simpson

[57] ABSTRACT

An electric clutch system for a mortise-type security lock is provided. The clutch system includes one or more magnets disposed in one hub of a mortise-type lock. The magnet is recessed and disposed below the interior surface of the hub that engages the opposing hub of the mortise-type lock. The opposing hub includes one or more spring-biased armatures. Upon the application of current to the magnet, the armature is drawn toward the magnet resulting in a coupling-type connection between the two hubs so that rotation of the exterior handle will open the door.

20 Claims, 2 Drawing Sheets

ELECTROMAGNETIC CLUTCH FOR ELECTRONIC LOCKS

BACKGROUND OF THE INVENTION

The present invention relates generally to electronic locks where the outside handle is deactivated unless power is supplied to the lock.

Electronic security locks for doors are known. Typically, the exterior handle of the security locks remains deactivated unless power is supplied to the lock system from an operator inside the building. For example, many apartment buildings include an electronic security lock that must be activated by a tenant or security guard disposed inside the building before someone outside the building can open the door. The mechanisms by which these locks operate can vary. In one design, the locking mechanism is disposed in the door jamb and is released when current is supplied to the door jamb This design is disadvantageous because it can be forced open upon the application of a significant force at the door jamb.

Many hotels and apartment buildings employ a mortise lock which includes an outer hub mounted onto the shaft connected to the outside handle and another inner hub mounted onto the shaft connected to the inside handle. The hub connected to the inside handle shaft is the hub that engages the latch bolt mechanism upon rotation. This will occur when the inside handle is rotated or when the outside handle is rotated and the outer hub is linked to the inner hub. This linking occurs only when the lock is activated.

Activation of mortise lock hubs is typically achieved using an electric motor which moves a connecting part that links the two hubs together so that rotation of the outer handle results in rotation of both the outer hub mounted to the outer handle shaft and rotation of the inner hub mounted onto the inner handle shaft. The employment of a motor or a significant amount of moving parts is problematic in terms of both cost of manufacture, maintenance and reliability.

Accordingly, there is a need for an electronic security lock, particularly of the mortise lock type, that is less expensive to manufacture, maintain and that is more reliable.

SUMMARY OF THE INVENTION

In satisfaction of the aforenoted need, the present invention provides a clutch mechanism for an electronic mortise-type lock. The lock includes a handle shaft that is connected to an exterior door handle and a latch bolt mechanism. The clutch mechanism of the present invention includes a first rotatable hub and a second rotatable hub. Each hub includes an inside surface disposed in an abutting engagement with the inside surface of the opposing hub. One of the hubs is connected to the handle shaft and rotates when the handle shaft is rotated. The other hub engages the latch bolt mechanism when it is rotated.

The first hub includes at least one electro-magnet disposed in a recessed position below the inside surface of the first hub thereby providing a clearance between the magnet and the inside surface of the first hub. The second hub includes at least one spring-biased armature that is biased below the inside surface of the second hub and is also in alignment with the electro-magnet of the first hub. The second hub is able to rotate freely with respect to the first hub when the armature is disposed below the inside surface of the second hub.

When the electro-magnet is magnetized, the armature is drawn toward the electro-magnet and into the clearance area of the first hub between the electro-magnet and the inside surface of the first hub. Therefore, upon the supplying of current to the electro-magnet, the electro-magnet is magnetized and the armature is drawn into the clearance area of the first hub thereby providing a clutch-type connection between the first and second hubs. Accordingly, rotation of the exterior handle, which normally rotates freely when the two hubs are not connected by the armature, results in a rotation of both the first and second hubs when the electro-magnet is magnetized which results in an engagement of the latch bolt mechanism by the second hub which results in an opening of the door.

In an embodiment, the first hub comprises two electro-magnets disposed on opposing sides of the handle shaft. Both magnets are disposed in a recessed position below the inside surface of the first hub thereby providing a clearance area between the magnets and the inside surface of the first hub. In such an embodiment, the second hub comprises two spring-biased armatures disposed on opposing sides of the second hub and in alignment with one of the electromagnets of the first hub. Upon the supply of current to the electro-magnets of the first hub, the armatures are drawn into the clearance areas of the first hub thereby providing a clutch-type connection between the first and second hubs.

In an embodiment, the first hub includes a central shaped opening for accommodating a handle shaft.

In an embodiment, the second hub includes a central shaped opening for accommodating a handle shaft.

In an embodiment, the armature is further characterized as including a disk which faces the electro magnet and which is drawn into the clearance area of the first hub. When the lock is deactivated, the disk of the armature is disposed in a first recessed area in the second hub. An opposing side of the disk is connected to a shaft which passes through a wall in the second hub into a second recessed area which houses a portion of the shaft and a spring. A distal end of the shaft is connected to a washer with the spring being disposed around the shaft and between the washer and the wall of the second hub. The biasing force of the spring maintains the disk portion of the armature in the first recessed area until the electro-magnet is magnetized thereby overcoming the bias of the spring to draw the disk portion of the armature into the clearance area of the first hub.

In an embodiment, one of the hubs is connected to an outer handle shaft that is connected to an exterior door handle and the other hub is connected to an inner handle shaft which is connected to an interior door handle.

In an embodiment, the first hub with the electro-magnet or electromagnets is mounted onto the outer handle shaft.

In an embodiment, the first hub with the electro-magnet or electro-magnets is mounted onto the inner handle shaft.

In an embodiment, the second hub with the armature or armatures is mounted onto the outer handle shaft.

In an embodiment, the second hub with the armature or armatures is mounted onto the inner handle shaft.

It is therefore an advantage of the present invention to provide an improved clutch for the two opposing hubs of a mortise-type lock.

Another advantage of the present invention is that it provides an improved electric clutch for a mortise-type security lock.

Still another advantage of the present invention is that it provides a simplified mechanism for activating and deactivating a mortise-type security lock with a minimum of moving parts.

Still another advantage of the present invention is that it provides an improved electronic security door system.

Other advantages and objects of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the present invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING THE PRESENTLY PREFERRED EMBODIMENTS

Figure 1:
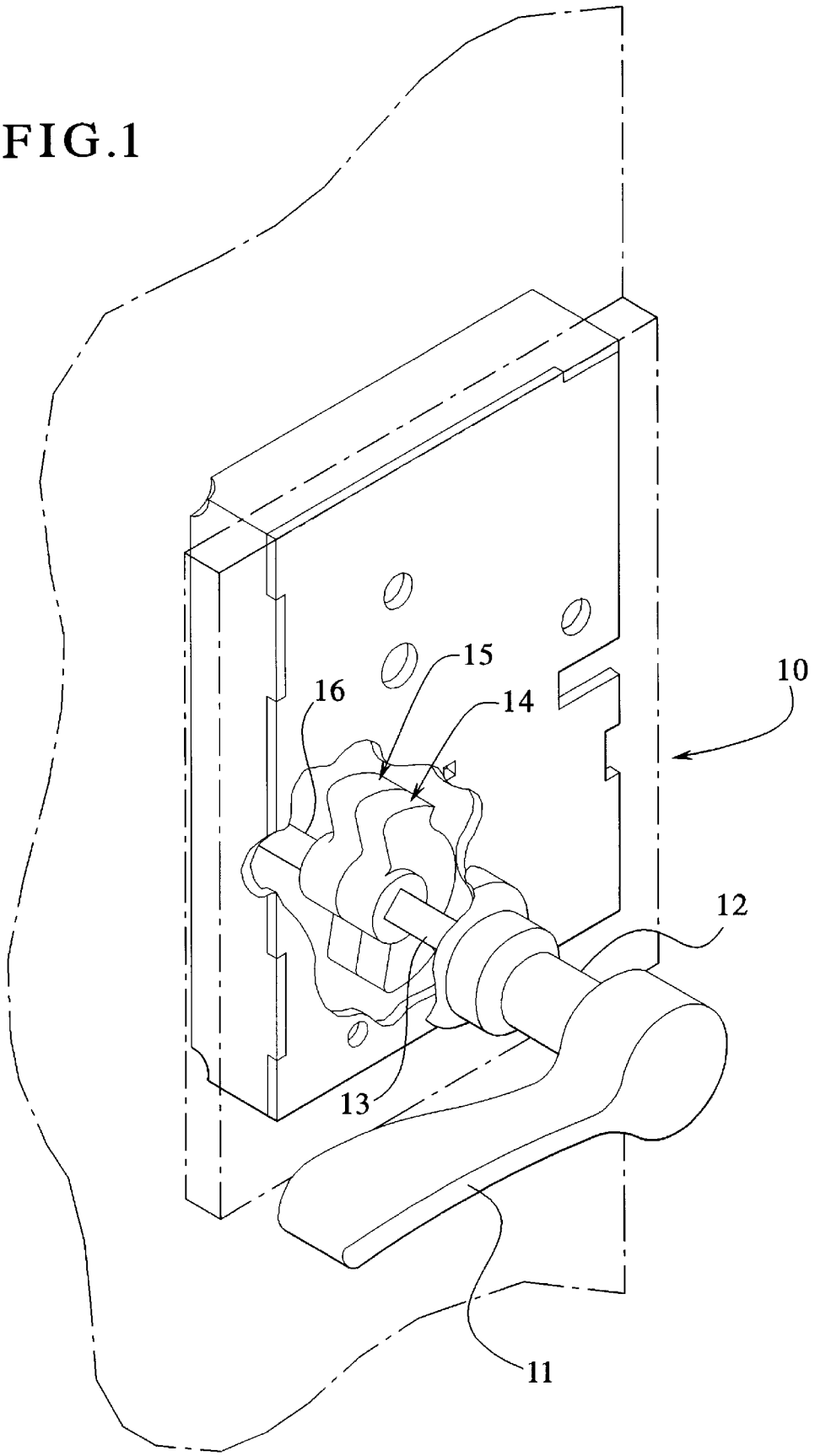
FIG. 1 is a Partial perspective view of a mortise-type lock suitable for incorporating the clutch mechanism of the present invention.

Turning to FIG. 1, mortise-type lock 10 is illustrated which includes an outer handle 11 connected to an outer hub 12 which is mounted onto an outer handle shaft 13. The outer handle shaft 13 is received in a first hub 14. The first hub 14 abuttingly engages a second hub 15 which is mounted to an inner handle shaft 16. It will be noted that the other remaining working parts of a typical mortise-type lock need not be explained here and have been omitted from FIG. 1 for simplicity. A suitable mortise-type lock is the Mortise American Steel Lock sold by ILCO Unican Corp. of St. Charles, Ill. and Winston Salem, N.C.

Figure 3:
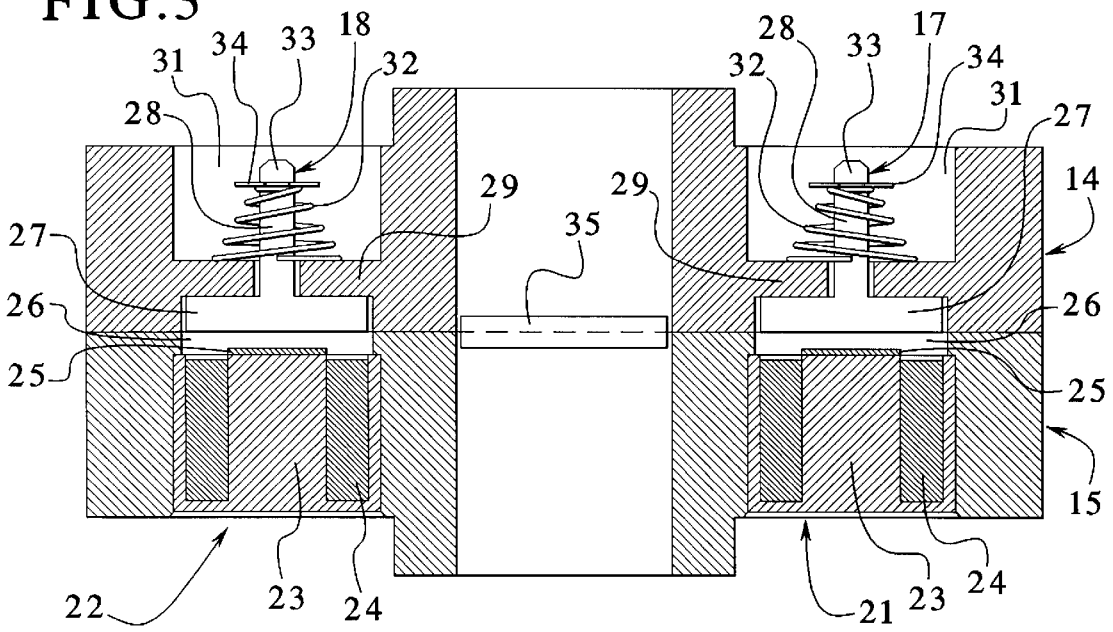
FIG. 3 a sectional view of the two hubs of the clutch mechanism of the present invention in the deactivated position.
Figure 4:
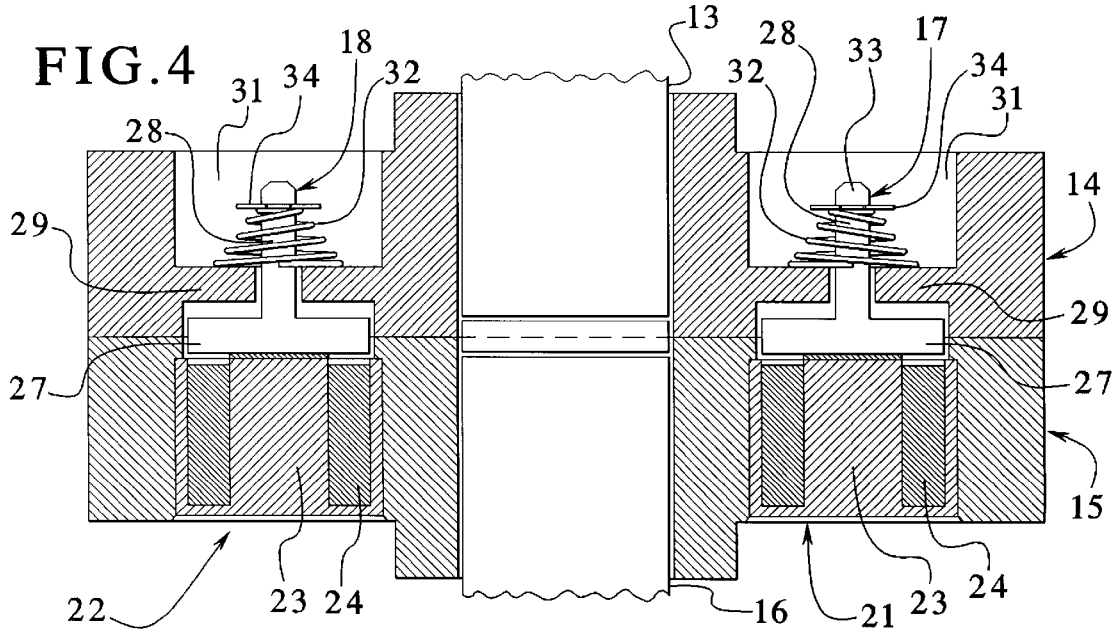
FIG. 4 is another sectional view of the two hubs of the clutch mechanism of the present invention in the activated position and further illustrating the location of two handle shafts.

As illustrated in FIGS. 3 and 4, the clutch mechanism of the present invention provides a means for connecting the hub 14 to the hub 15 so that rotation of the hub that is connected to the outer handle shaft 13, whether it be the hub 14 or the hub 15, results in rotation of the other hub. For purposes of illustration in FIG. 4, it is assumed that the outer handle shaft 13 is received in the hub 14 which includes the armatures 17, 18 and that the inner handle shaft 16 is received in the hub 15 that includes the magnets 21, 22. However, the magnets 21, 22 may be incorporated into the hub that is mounted onto the outer handle shaft 13 and the armatures 17, 18 may be incorporated into the hub that is mounted onto the inner handle shaft 16. In short, the configuration of the hubs 14, 15 with respect to the shafts 13, 16 as illustrated in FIG. 4 is reversible.

Further, it will be noted that the hub 14 includes two armatures 17,18 and that the hub 15 includes two magnets 21, 22. However, it will be noted that the hub 14 need only include one armature and that the hub 15 need only include one magnet. The connection established between the hubs 14 and 15 by a single armature/magnet combination as shown in FIG. 4 and discussed below is sufficient to connect the hub 14 to the hub 15 for rotation of both hubs 14,15 together.

Turning to FIG. 3, the magnets 21, 22 each include a housing 23 and a coil 24. Preferably, the magnets 21, 22 are magnetized by the application of 12 volts of direct current. A layer of insulation is shown at 25. It will be noted that the magnets 21, 22 are disposed in the hub 15 in a recessed position thereby creating two clearance areas shown at 26. As shown in FIG. 4, the armatures 17, 18 are drawn downward into these clearance areas when the magnets 21, 22 are magnetized upon the application of current to the magnets 21, 22.

The armatures 17, 18 each include a lower disk 27 which is connected to a shaft 28. The shaft 28 passes through a wall 29 disposed in the hub 14 between the recessed area 31 which accommodates a portion of the shaft 28 as well as the spring 32 and an inner recessed area in which the disk portion 27 is disposed in the deactivated position as shown in FIG. 3. The distal ends 33 of the shafts 28 include washers 34. The springs 32 are disposed between the washers 34 and the walls shown at 29 and bias the armatures 17, 18 upward into the position shown in FIG. 3 when the magnets 21, 22 are not magnetized. However, upon the application of current to the magnets 21, 22, the armatures are drawn into the position shown in FIG. 4 where the disk portions 27 of the armatures enter the clearance areas 26 of the hubs 15 thereby providing a connection between the hub 14 and the hub 15 so that rotation of one hub, either the hub 14 or the hub 15, will result in rotation of both hubs 14 and 15.

In the configuration illustrated in FIG. 4, the outer shaft 13 accommodated in the middle of the hub 14, rotation of the outer handle 11 (see FIG. 1) will result in rotation of the outer shaft 13, the hub 14 as well as the hub 15 and inner handle 16 due to the connection between the hubs 14 and 15 as illustrated in FIG. 4. A spacer plate is shown at 35 which separates the shafts 13, 16 and further insures that the outer shaft 13 will rotate freely when the clutch mechanism is in the demagnetized or deactivated position as shown in FIG. 3.

Figure 2:
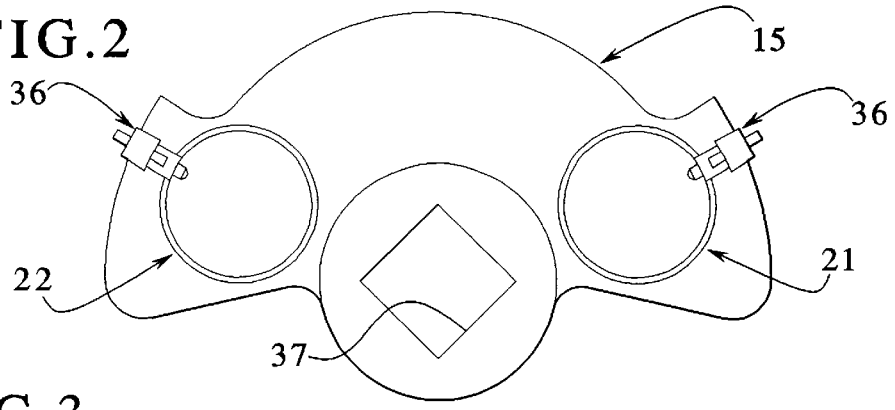
FIG. 2 bottom schematic view of a hub equipped with two electromagnets for use in the mechanism of the present invention.

FIG. 2 illustrates the electrical connections 36 which provide current to the magnets 21, 22. The aperture 37 disposed in the hub 15 is shaped to accommodate a similarly-shaped shaft 16 or shaft 13.

Accordingly, an electric clutch mechanism is provided for a mortise-type lock which insures that the outer handle 11 and outer handle shaft 13 rotate freely when the lock is in the deactivated or de-magnetized position. Further, the lock is activated by a simple mechanism whereby current is supplied to one or more magnets disposed in a hub which draws one or more armatures toward the magnet or magnets to thereby provide a frictional connection between two opposing and abutting hubs. With the hubs connected, rotation of the outer shaft activates the latch mechanism to thereby open the door.

From the above description, it is apparent that the advantages and objects of the present invention have been achieved. While only certain embodiments have been set forth, alternative embodiments and various modifications will be apparent from the above description to those skilled in the art. For example, the hubs 14, 15 may include only a single armature and a single magnet respectively. The dual-armature/dual-magnet design illustrated in FIGS. 3 and 4 is a preferred embodiment, not the only available embodiment. Still further, the hubs 14, 15 as illustrated are interchangeable. That is, the hub 14 may be disposed on the outer shaft 13 or the inner shaft 16. Similarly, the hub 15 may be disposed on the outer shaft 13 as well as the inner shaft 16. While it has been suggested that the magnets be activated by 12 volts of direct current, other magnet systems will be available and apparent to those skilled in the art. Similarly, the design of the armatures 17, 18 as illustrated can vary and alternative designs will be apparent to those skilled in the art.

What is claimed is:

1. A clutch mechanism for an electronic lock, the electronic lock including a handle shaft connected to an exterior door handle and a latch bolt mechanism, the clutch mechanism comprising:

a first rotatable hub and a second rotatable hub disposed in an opposing relationship to the first hub, each hub including an inside surface disposed in an abutting engagement with the inside surface of the other hub, one of the hubs adapted to be to connected the handle shaft for rotation upon rotation of the handle shaft, the other hub adapted to engage the latch bolt mechanism upon rotation of said other hub, the first hub including an electro-magnet being disposed in a recessed position below the inside surface of the first hub thereby providing a clearance area between the electro-magnet and the inside surface of the first hub, the electro-magnet being connected to a power source, the second hub including an armature that is spring biased below the inside surface of the second hub and in alignment with the electro-magnet of the first hub, the second hub being able to rotate freely with respect to the first hub when the armature is disposed below the inside surface of the second hub, the armature being drawn toward the electro-magnet and into the clearance area of the first hub when the electro-magnet is magnetized, the first and second hubs rotating together when the armature is disposed in the clearance area.

2. The clutch mechanism of claim 1 wherein the first hub comprises two electro-magnets disposed on opposing sides of the first hub and in a recessed position below the inside surface of the first hub with a clearance area disposed between each electro-magnet and the inside surface of the first hub, and the second hub comprises two spring biased armatures disposed on opposing sides of the second hub, each armature being in alignment with one of the electro-magnets of the first hub, each armature being biased below the inside surface of the second hub when the electro-magnets are not magnetized and each armature being drawn towards one of the electro-magnets and into one of the clearances areas when the electro-magnets are magnetized.

3. The clutch mechanism of claim 1 wherein the first hub includes a central shaped opening for accommodating the handle shaft.

4. The clutch mechanism of claim 1 wherein the second hub includes a central shaped opening for accommodating the handle shaft.

5. The clutch mechanism of claim 1 wherein the armature further comprises a disk having a flat surface that faces the electro-magnet and an opposing surface that is connected to a shaft, the second hub further comprising a first recessed area for accommodating the disk of the armature and a second recessed area for accommodating a portion of the shaft and a spring, the second hub further comprising a wall disposed between the first and second recessed areas and a narrow opening in the wall through which the shaft passes from the first recessed area into the second recessed area, the shaft comprising a distal end which accommodates a washer, the spring being disposed between and engaging the washer and the wall thereby biasing the disk of the armature into the first recessed area of the second hub.

6. A clutch mechanism for an electronic lock, the electronic lock including an outer handle shaft connected to an exterior door handle, an inner handle shaft connected to an interior door handle and a latch bolt mechanism, the clutch mechanism comprising:

a first rotatable hub and a second rotatable hub, each hub including an inside surface disposed in an abutting engagement with the inside surface of the other hub, one of the hubs adapted to be connected to the outer handle shaft, the other hub adapted to be connected to the inner handle shaft and also adapted to engage the latch bolt mechanism upon rotation of the inner handle shaft or upon rotation of the first and second hubs together, the first hub including an electro-magnet being disposed in a recessed position below the inside surface of the first hub thereby providing a clearance area between the electro-magnet and the inside surface of the first hub, the electro-magnet being connected to a power source, the second hub including an armature that is spring biased below the inside surface of the second hub and in alignment with the electro-magnet of the first hub, the second hub being able to rotate freely with respect to the first hub when the armature is disposed below the inside surface of the second hub, the armature being drawn toward the electro-magnet and into the clearance area of the first hub when the electro-magnet is magnetized, the first and second hubs rotating together when the armature is disposed in the clearance area.

7. The clutch mechanism of claim 6 wherein the first hub comprises two electro-magnets disposed on opposing sides of the first hub and in a recessed position below the inside surface of the first hub with a clearance area disposed between each electro-magnet and the inside surface of the first hub, and the second hub comprises two spring biased armatures disposed on opposing sides of the second hub, each armature being in alignment with one of the electro-magnets of the first hub, each armature being biased below the inside surface of the second hub when the electro-magnets are not magnetized and each armature being drawn towards one of the electro-magnets and into one of the clearances areas when the electro-magnets are magnetized.

8. The clutch mechanism of claim 6 wherein the first hub includes a central shaped opening for accommodating one of the handle shafts.

9. The clutch mechanism of claim 6 wherein the second hub includes a central shaped opening for accommodating one of the handle shafts.

10. The clutch mechanism of claim 6 wherein the armature further comprises a disk having a flat surface that faces the electro-magnet and an opposing surface that is connected to a shaft, the second hub further comprising a first recessed area for accommodating the disk of the armature and a second recessed area for accommodating a portion of the shaft and a spring, the second hub further comprising wall disposed between the first and second recessed areas and a narrow opening in the wall through which the shaft passes from the first recessed area into the second recessed area, the shaft comprising a distal end which accommodates a washer, the spring being disposed between and engaging the washer and the wall thereby biasing the disk of the armature into the first recessed area of the second hub.

11. A clutch mechanism for an electronic lock, the electronic lock including an outer handle shaft connected to an exterior door handle, an inner handle shaft connected to an interior door handle and a latch bolt mechanism, the clutch mechanism comprising:

a first rotatable hub and a second rotatable hub, each hub including an inside surface disposed in an abutting engagement with the inside surface of the other hub, the first hub adapted to be connected to the outer handle shaft, the second hub adapted to be connected to the inner handle shaft and also adapted to engage the latch bolt mechanism upon rotation of the inner handle shaft or upon rotation of the first and second hubs together, the first hub including an electro-magnet being disposed in a recessed position below the inside surface of the first hub thereby providing a clearance area between the electro-magnet and the inside surface of the first hub, the electro-magnet being connected to a power source, the second hub including an armature that is spring biased below the inside surface of the second hub and in alignment with the electro-magnet of the first hub, the second hub being able to rotate freely with respect to the first hub when the armature is disposed below the inside surface of the second hub, the armature being drawn toward the electro-magnet and into the clearance area of the first hub when the electro-magnet is magnetized, the first and second hubs rotating together when the armature is disposed in the clearance area, whereby rotation of the outer handle shaft when the electro-magnet is not magnetized results in rotation of the first hub only and not rotation of the first and second hubs together, and whereby rotation of the inner handle shaft results in rotation of the second hub regardless of whether the electro-magnet is magnetized.

12. The clutch mechanism of claim 11 wherein the first hub comprises two electro-magnets disposed on opposing sides of the first hub and in a recessed position below the inside surface of the first hub with a clearance area disposed between each electro-magnet and the inside surface of the first hub, and the second hub comprises two spring biased armatures disposed on opposing sides of the second hub, each armature being in alignment with one of the electro-magnets of the first hub, each armature being biased below the inside surface of the second hub when the electro-magnets are not magnetized and each armature being drawn towards one of the electro-magnets and into one of the clearances areas when the electro-magnets are magnetized.

13. The clutch mechanism of claim 11 wherein the first hub includes a central shaped opening for accommodating the outer handle shaft.

14. The clutch mechanism of claim 11 wherein the second hub includes a central shaped opening for accommodating the inner handle shaft.

15. A clutch mechanism for an electronic lock, the electronic lock including an outer handle shaft connected to an exterior door handle, an inner handle shaft connected to an interior door handle and a latch bolt mechanism, the clutch mechanism comprising:

a first rotatable hub and a second rotatable hub, each hub including an inside surface disposed in an abutting engagement with the inside surface of the other hub, the first hub adapted to be connected to the outer handle shaft, the second hub adapted to be connected to the inner handle shaft and also adapted to engage the latch bolt mechanism upon rotation of the inner handle shaft or upon rotation of the first and second hubs together, the second hub including an electro-magnet being disposed in a recessed position below the inside surface of the second hub thereby providing a clearance area between the electro-magnet and the inside surface of the second hub, the electro-magnet being connected to a power source, the fist hub including an armature that is spring biased below the inside surface of the first hub and in alignment with the electro-magnet of the second hub, the first hub being able to rotate freely with respect to the second hub when the armature is disposed below the inside surface of the first hub, the armature being drawn toward the electro-magnet and into the clearance area of the second hub when the electro-magnet is magnetized, the first and second hubs rotating together when the armature is disposed in the clearance area, whereby rotation of the outer handle shaft when the electro-magnet is not magnetized results in rotation of the first hub only and not rotation of the first and second hubs together, and whereby rotation of the inner handle shaft results in rotation of the second hub regardless of whether the electro-magnet is magnetized.

16. The clutch mechanism of claim 15 wherein the second hub comprises two electro-magnets disposed on opposing sides of the second hub and in a recessed position below the inside surface of the second hub with a clearance area disposed between each electro-magnet and the inside surface of the second hub, and the first hub comprises two spring biased armatures disposed on opposing sides of the first hub, each armature being in alignment with one of the electro-magnets of the second hub, each armature being biased below the inside surface of the first hub when the electro-magnets are not magnetized and each armature being drawn towards one of the electro-magnets and into one of the clearances areas when the electro-magnets are magnetized.

17. The clutch mechanism of claim 15 wherein the second hub includes a central shaped opening for accommodating the inner handle shaft.

18. The clutch mechanism of claim 15 wherein the first hub includes a central shaped opening for accommodating the outer handle shaft.

19. An electronic door lock comprising:

an outer handle shaft connected to an exterior door handle, an inner handle shaft connected to an interior door handle, the door lock further comprising a clutch mechanism for deactivating the exterior door handle when power is not being supplied from a power source to an electromagnet of the clutch mechanism, the clutch mechanism comprising a first rotatable hub and a second rotatable hub, each hub including an inside surface disposed in an abutting engagement with the inside surface of the other hub, the first hub being mounted onto the outer handle shaft, the second hub being mounted onto the inner handle shaft and also engaging a latch bolt mechanism upon rotation of the inner handle shaft or upon rotation of the first and second hubs together, the first hub including two electro-magnets which are disposed on opposing sides of the outer handle shaft and in recessed positions below the inside surface of the first hub thereby providing a clearance area between the electro-magnets and the inside surface of the first hub, the electro-magnets each being connected to the power source, second hub including two armatures disposed on opposing sides of the inner handle shaft and that are spring biased below the inside surface of the second hub, each armature being in alignment with one of the electro-magnets of the first hub, the second hub being able to rotate freely with respect to the first hub when each of the armatures is disposed below the inside surface of the second hub, each armature being drawn toward its respective electro-magnet and into the respective clearance area of the first hub when the electro-magnets are magnetized, the first and second hubs rotating together when the armatures are disposed in the clearance areas, whereby rotation of the outer handle shaft when the electro-magnets are not magnetized results in rotation of the first hub only and not rotation of the first and second hubs together, and whereby rotation of the inner handle shaft results in rotation of the second hub regardless of whether the electro-magnets are magnetized.

20. An electronic door lock comprising:

an outer handle shaft connected to an exterior door handle, an inner handle shaft connected to an interior door handle, the door lock further comprising a clutch mechanism for deactivating the exterior door handle when power is not being supplied from a power source to an electromagnet of the clutch mechanism, the clutch mechanism comprising a first rotatable hub and a second rotatable hub, each hub including an inside surface disposed in an abutting engagement with the inside surface of the other hub, the first hub being mounted onto the outer handle shaft, the second hub being mounted onto the inner handle shaft and also engaging a latch bolt mechanism upon rotation of the inner handle shaft or upon rotation of the first and second hubs together, the second hub including two electro-magnets which are disposed on opposing sides of the inner handle shaft and in recessed positions below the inside surface of the second hub thereby providing a clearance area between the electro-magnets and the inside surface of the second hub, the electro-magnets each being connected to the power source, the first hub including two armatures disposed on opposing sides of the outer handle shaft and that are spring biased below the inside surface of the first hub, each armature being in alignment with one of the electro-magnets of the second hub, the first hub being able to rotate freely with respect to the second hub when each of the armatures is disposed below the inside surface of the first hub, each armature being drawn toward its respective electro-magnet and into the respective clearance area of the second hub when the electro-magnets are magnetized, the first and second hubs rotating together when the armatures are disposed in the clearance areas, whereby rotation of the outer handle shaft when the electro-magnets are not magnetized results in rotation of the first hub only and not rotation of the first and second hubs together, and whereby rotation of the inner handle shaft results in rotation of the second hub regardless of whether the electro-magnets are magnetized.

* * * * *